US006986344B2

(12) United States Patent
Meister et al.

(10) Patent No.: US 6,986,344 B2
(45) Date of Patent: Jan. 17, 2006

(54) BLADESHAFT ASSEMBLY FOR A POWERED SAW OR CUTTING MACHINE

(75) Inventors: Donald F. Meister, Overland Park, KS (US); Michael G. Kingsley, Wellsville, KS (US); Douglas Dempsey, Pleasant Hill, MO (US)

(73) Assignee: Electrolux Professional Outdoor Products, Inc, Cleveland, OH (US)

( * ) Notice: Subject to any disclaimer, the term of this patent is extended or adjusted under 35 U.S.C. 154(b) by 0 days.

(21) Appl. No.: 10/779,521

(22) Filed: Feb. 13, 2004

(65) Prior Publication Data

US 2005/0178376 A1 Aug. 18, 2005

(51) Int. Cl.
*B24B 41/00* (2006.01)

(52) U.S. Cl. ..... 125/13.01; 384/144

(58) Field of Classification Search ..... 384/144, 384/537, 271, 272, 398; 125/13.01
See application file for complete search history.

(56) References Cited

U.S. PATENT DOCUMENTS 4,829,718 A * 5/1989 Behm ..... 451/342
5,153,990 A * 10/1992 Martinie ..... 29/898.07
2002/0058560 A1 * 5/2002 Fujiwara ..... 474/199
2002/0134974 A1 * 9/2002 Fujiwara et al. ..... 254/391
2004/0242125 A1 * 12/2004 Wakazono et al. ..... 451/11

* cited by examiner

*Primary Examiner*—Jacob K. Ackun, Jr.
(74) *Attorney, Agent, or Firm*—Pearne & Gordon LLP

(57) ABSTRACT

A bladeshaft assembly for a cutting saw includes a hollow tubular housing member. A shaft member extends coaxially through the tubular housing member and has at least one end that extends outwardly of the tubular housing member. At least one bearing member is disposed in surrounding relation to a portion of the shaft member. A seal is provided for sealing around the at least one end of the shaft member. A pulley member is mounted on the at least one end of the shaft member that extends outwardly of the tubular housing member. A tapered fit is formed cooperatively between the pulley member and the end of the shaft member so as to enable a press fit relation between the pulley member and the end of the shaft member. Additionally, first and second gauge points are formed respectively between the pulley member and the at least one end of said shaft member; the first and second gauge points engaging one another so as to establish a predetermined placement of the pulley member on the end of the shaft member.

2 Claims, 5 Drawing Sheets

BLADESHAFT ASSEMBLY FOR A POWERED SAW OR CUTTING MACHINE

FIELD OF THE INVENTION

This invention relates to a bladeshaft assembly for a powered cutting saw as may be used in the construction and concrete cutting applications. More particularly, this invention relates to such a bladeshaft assembly as includes an improved pulley attachment arrangement as well as improved seal configuration at the bladeshaft tube ends wherein sealed bearings reside.

BACKGROUND OF THE INVENTION

Bladeshaft assemblies as may be used in construction equipment such as concrete cutting road saws are subject to extreme wear and adverse operating conditions. For instance, the amount of concrete dust and the necessary fluid slurry for keeping the dust down, generated when such a concrete cutting saw is used to cut into highway concrete, has an extremely negative effect on the life and operating characteristics of any component in the concrete cutting machine. Constant exposure to such dust and slurry can result in the need to service and replace components on a frequent basis that at times can be on the order of requiring service every eight hours. Of course, in the construction industry, it is highly undesirable to require servicing of the equipment on such a frequent basis since any such service requirement results in a stoppage of work and can delay a project. Accordingly, it would be desirable to provide a bladeshaft assembly for a concrete cutting saw that extended the amount of time between needed service actions.

An additional problem in the construction or concrete cutting business is an out of tolerance condition that may occur because of the high vibration experienced during the concrete cutting operation. For instance, if the relative displacement between the pulley on the drive shaft and the pulley on the bladeshaft change due to drift in positioning of one or the other of such pulleys as may be caused by vibration, excess wear will occur to the belt connecting the two pulleys as well as the actual cutting blade itself. Accordingly, it would be further advantageous if a bladeshaft assembly could be provided that would be less susceptible to drift in component placement as may be caused by the high-vibration characteristics of the concrete cutting environment.

Still another problem encountered in the concrete cutting environment is the susceptibility of the dust and slurry contamination entering the sealed area where the shaft bearings reside. Under such conditions, it may again be necessary to service the cutting machine on a more frequent basis than desired and as well, may result in the costly exercise of having to replace the entire blade shaft assembly if the servicing is not done when required. Servicing the bladeshaft assembly to repair or replace the shaft bearings is further complicated by the fact that the combination of the concrete dust and the slurry can create a hardened coating over the seal and attachment arrangement that protects the sealed bearing area. Given the problem of the difficulty in accessing the sealed bearing area due to concrete dust and slurry contamination, it would be advantageous if a sealing arrangement could be provided that would allow for substantially eliminating the contamination from entering the sealed bearing area and even more beneficial, in the unlikely event contamination did enter the bearing area, a simple and reliable attachment configuration would be provided to service the bearing area without the need to replace the entire bladeshaft assembly.

Yet another problem that has arisen in the manufacture and maintenance of concrete cutting machines is the time-consuming and unreliable method of positioning the pulleys on the respective drive and bladeshafts so as to be assured the alignment of such pulleys is substantially accurate. A typical pulley and shaft attachment arrangement involves a pulley have a center opening that is sized slightly larger than the diameter of the shaft on which it is to be mounted. The pulley is then secured to the shaft end by means of a number of setscrews that are tightened down onto the shaft. In the manufacturing process for performing this attachment, a worker must carefully assure that the displacement of the pulley on the shaft is accurate so that the pulley aligns appropriately with the counterpart pulley from the drive shaft. This process is time-consuming, is subject to assembly error and does not provide for consistent repeatable results for all concrete saw machines that are manufactured. The problem of alignment of the pulley onto the shaft during the initial manufacturing operation is also experienced in the field where it becomes necessary to replace a worn pulley. Additionally, because there is a difference in the diameter opening of the pulley and the diameter of the shaft, by securing the set screws onto the shaft, there is a tendency to render the shaft and pulley assembly as non-centric. In other words, the outer diameter of the pulley will not be concentric with the center longitudinal axis of the shaft. The effect of such non-centricity is that the cutting blade will be exposed to significantly more vibration and will not be as balanced as would be possible if the pulley and the blade shaft were concentric. Based on the problems associated with accurately and consistently aligning the pulley on the shaft, it would be advantageous if a better arrangement for attaching the pulley onto the shaft were developed, such better arrangement assuring that the results in both the manufacturing process and the service operation are accurate, repeatable and can be achieved in a simple and efficient manner.

SUMMARY OF THE INVENTION

The present invention provides an improved bladeshaft assembly for use with a cutting machine as may be used in the concrete and construction industries. The bladeshaft assembly of the present invention includes a hollow tubular housing member. A shaft member extends coaxially through the tubular housing member and has at least one end that extends outwardly of the tubular housing member. At least one bearing member is disposed in surrounding relation to a portion of the shaft member. A sealing arrangement is disposed around the at least one end of the shaft member as it extends outwardly of the tubular housing member. A pulley member is mounted on the at least one end of the shaft member that extends outwardly of the tubular housing member. A tapered fit is formed cooperatively between the pulley member and the at least one end of the shaft member so as to enable a press fit relation between the pulley member and at least end of the shaft member. First and second gauge points are formed respectively between the pulley member and the at least one end of the shaft member; the first and second gauge points engage one another so as to establish a predetermined placement of the pulley member on the at least one end of the shaft member.

In an alternate embodiment of the invention, the sealing arrangement disposed at the opening of the tubular housing member adjacent to where the bearing members are disposed includes a cover seal member and a slinger shaft member that are cooperatively formed so as to provide a labyrinth path therebetween. A re-lubrication path is formed in one of the cover seal member and the slinger shaft member so as to allow the introduction of lubrication into the labyrinth thereby providing that any contaminant materials that may have worked its way toward the sealed bearings, can be purged.

BRIEF DESCRIPTION OF THE DRAWINGS

These and further features will be apparent with reference to the following description and drawings, wherein.

DETAILED DESCRIPTION OF THE INVENTION

Figure 1:
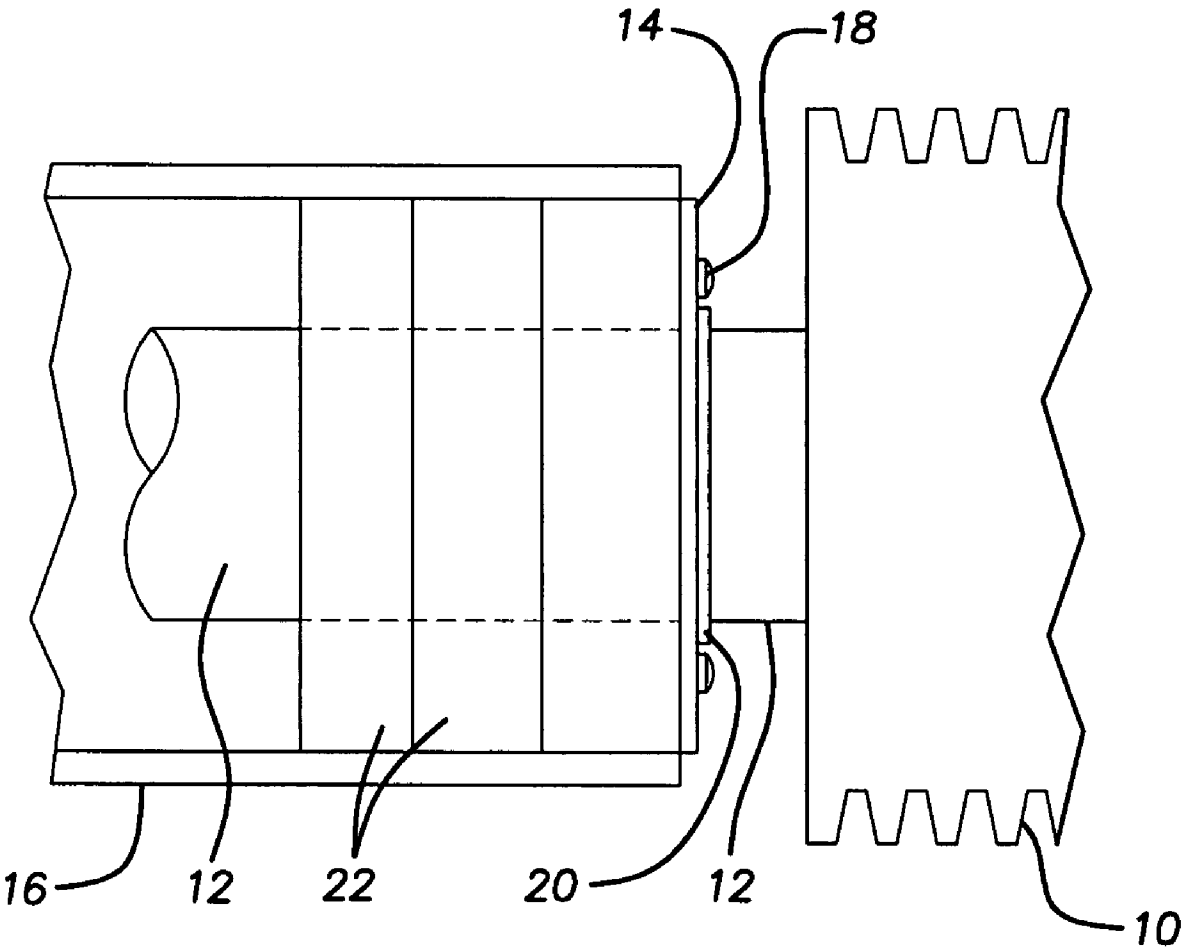
FIG. 1 PRIOR ART
FIG. 1 is an elevational view of a blade shaft assembly constructed in accordance with prior art teachings.

As seen in FIG. 1, the bladeshaft assembly constructed according to the teachings of the prior art includes a pulley 10 mounted on a shaft 12. Typically, the pulley 10 is secured to the shaft 12 by a number of set screws (not shown) that are tightened by way of an allen head fitting on the set screw. The shaft 12 extends through an end cap 14 that is fastened to the end of a bladeshaft tube 16. The end cap 14 is typically secured to the bladeshaft tube 16 by means of set screws 18. An end seal 20 is located inside of the end cap 14 and acts to prevent some contaminants from entering the region where bearings 22 are disposed. As discussed, the problems with such a prior art arrangement are that it is difficult to manufacture and service the bladeshaft assembly under the difficult environmental conditions that concrete and heavy construction cutting is done.

Figure 2:
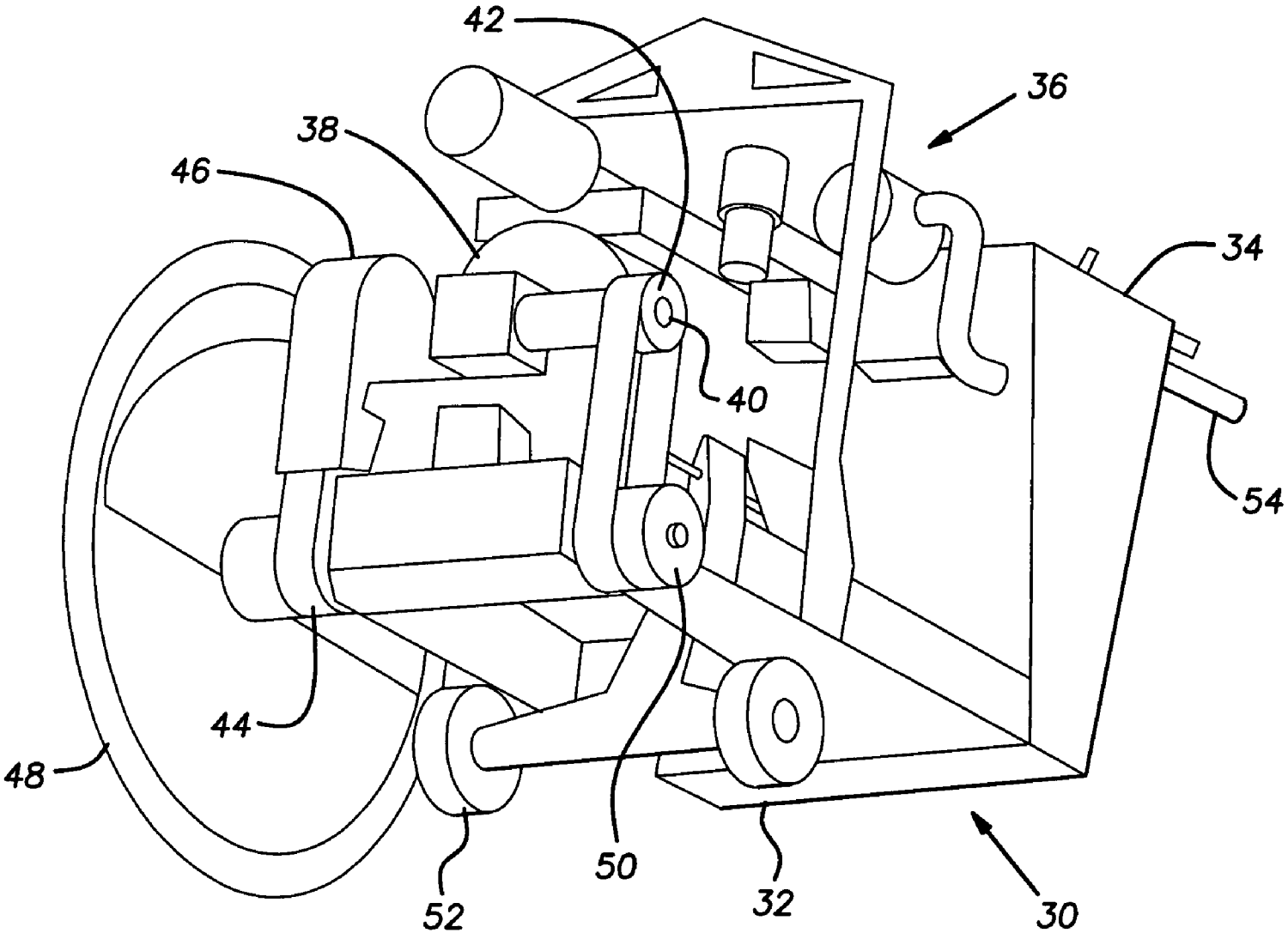
FIG. 2 is an elevational view of a concrete cutting machine that incorporates the bladeshaft assembly constructed in accordance with the present invention.

As seen in FIG. 2, a concrete cutting saw 30 on which the bladeshaft assembly 50 of the present invention is mounted includes a baseframe 32 on which a control panel 34 is mounted on the rearward side and an engine 36 is mounted adjacent thereto. The engine powers a drive train 38 from which extends a drive shaft 40. The control panel 34 includes operator controls (not shown) for allowing the operator to control the cutting blade 48 and the engine 36 in a manner that is known to those skilled in the art.

A drive pulley 42 is mounted on the end of the drive shaft 40. The pulley 42 of the drive shaft 40 is connected to the bladeshaft assembly 50 by means of a belt 44. A belt cover 46 can be disposed over the belt 44 so as to protect the belt 44 from the harsh conditions under with the concrete cutting saw 30 operates. A cutting blade 48 can be mounted on the end of the bladeshaft assembly 50. It should be noted that the concrete cutting saw 30 can accommodate the mounting of a cutting blade 48 on either the left or the right side of the bladeshaft assembly 50. This feature is necessary so that the concrete cutting saw operator has the ability to cut from either the left or the right side of the cutting machine 30.

An axle and wheel assembly 52 is mounted on the bottom portion of the baseframe 30. As is known in the art, the axle and wheel assembly 52 can be powered by the engine 36 or other motive force to allow for driving the cutting machine 30 forward or backward. Control handles 54 extend from the control panel 34 and allow the operator the ability to maneuver the cutting machine 30.

Figure 3:
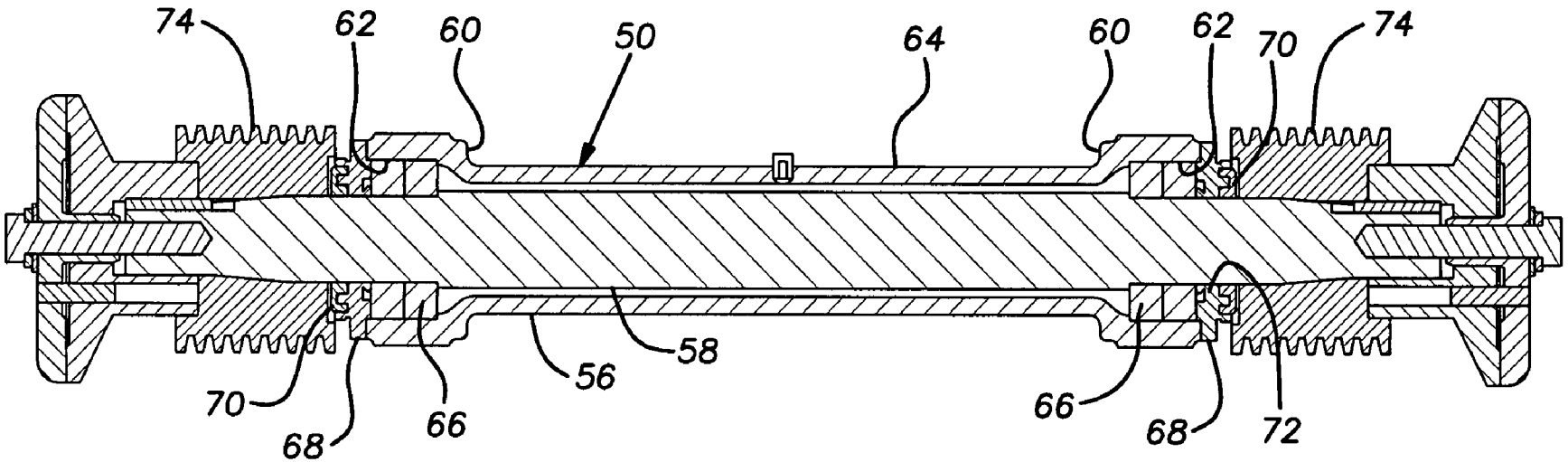
FIG. 3 is an elevational view in section of the bladeshaft assembly constructed in accordance with the present invention.

As seen in FIG. 3, the bladeshaft assembly 50 includes a tubular member 56 through which a shaft member 58 extends coaxially. The tubular member 56 has raised end portions 60 disposed on opposite ends thereof. The raised end portions 60 have a larger inner diameter opening than the center portion 64 of the tubular member 56. The raised end portions 60 are sized so as to accommodate the diametric size of the bearing members 66 that are disposed therein. As shown in FIG. 3, a pair of bearing members 66 is disposed at each end. The bearing members 66 can be of a type that are pre-packed and sealed and require little if any further lubrication over the lives thereof. As will be described more fully with respect to FIG. 4, the raised end portions 60 and the bearing members 66 residing therein are sealed at their respective ends by flange end covers 68. Disposed along shaft member 58 adjacent the flange end covers 68 are respective shaft slinger members 70. Both the flange end covers 68 and the corresponding shaft slinger members 70 are machined so as to have a center opening 72 formed therein; the shaft member 58 extends through the center openings 72 so as to extend outwardly of the tubular member 56 and end cover configuration.

Figure 4:
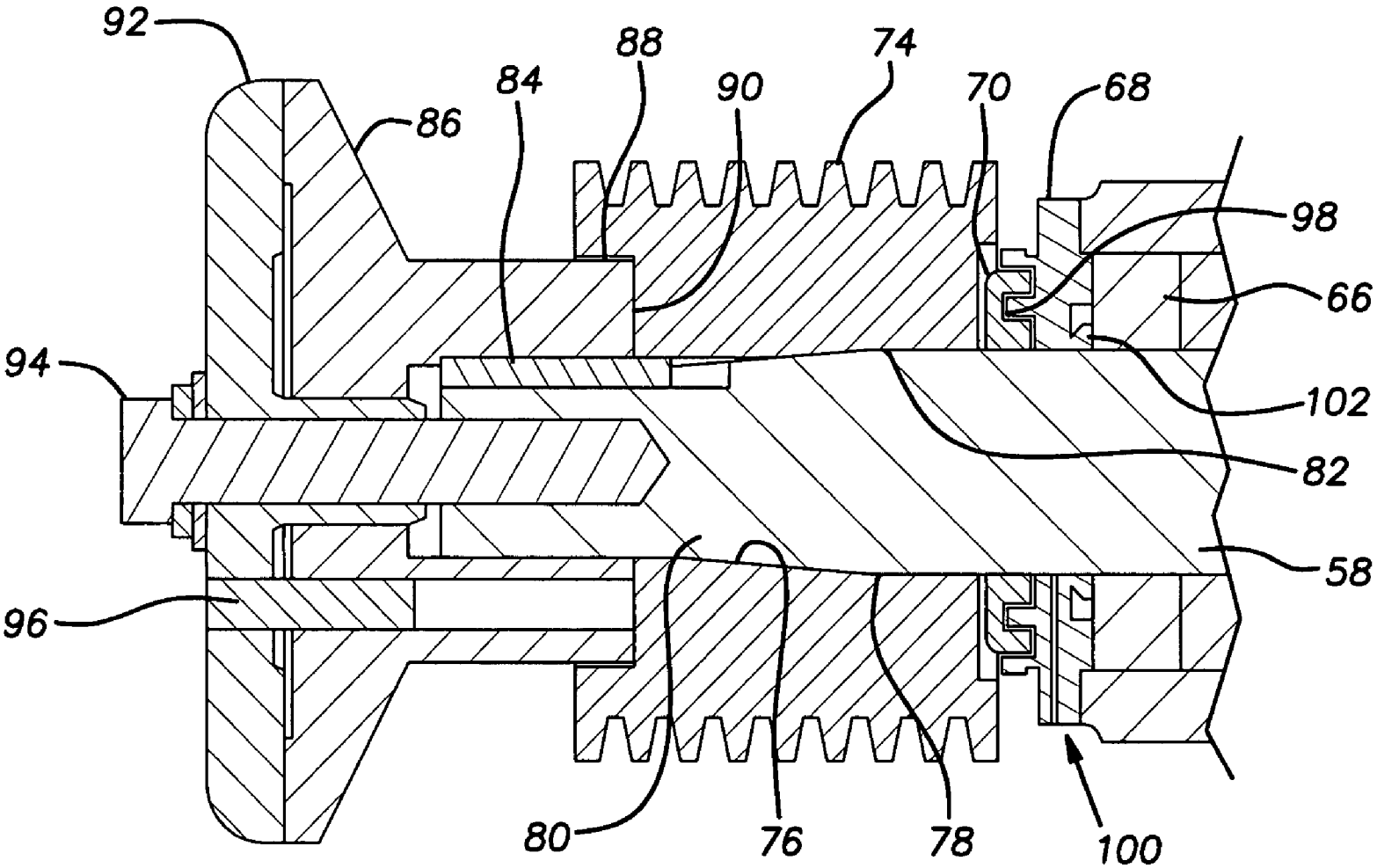
FIG. 4 is an elevational view in section of one end of a bladeshaft assembly constructed in accordance with the present invention.

At a position along the shaft member 58 as it exits each end of the tubular member 56 and end cover configuration, a pulley member 74 is disposed thereon. With reference now to FIG. 4, it can be seen that the inner opening 76 of the pulley member 74 is tapered. The shape and angle of taper of the inner opening 76 is machine controlled so as to achieve a uniform dimension that is consistent for all shaft members 58 used in the bladeshaft assemblies 50. As further seen in FIG. 4, the taper of the inner opening 76 does not begin at the immediate point of entry but instead begins at gauge point 78. The distance from the initial opening into inner opening 76 to the gauge point 78 is also accurately controlled during the machining operation for the pulley member 74. In the same way that the dimensions of the inner opening 76 of pulley member 74 is maintained to a high degree of accuracy, the taper of the shaft end 80 is also similarly controlled. Specifically, as seen in FIG. 4, the shaft end 80 of shaft member 58 is tapered in a corresponding manner to the taper of the inner opening 76 of pulley member 74. In addition, a shaft gauge point 82 is formed on shaft member 58 in a manner so as to coincide with gauge point 78 of the inner opening of pulley member 74.

Given the relationship between the taper dimensions of the shaft end 80 and the inner opening 78 of pulley member 74 as well as the corresponding placement of the gauge point 78 and the shaft gauge point 82, it can be appreciated that during the manufacturing process for bladeshaft assembly 50, a repeatable and accurate placement of the pulley member 74 onto shaft member 58 is achieved by means of a press fitting. Additionally, by press fitting the pulley member 74 onto shaft member 58, the need for set screw attachment is avoided and problems of non-centricity between the pulley outer diameter and shaft member 58 axis, do not occur.

Once the pulley member 74 has been press fit onto the tapered shaft end 80, a key member 84 can be inserted into a keyed slot formed cooperatively in one or both of the tapered shaft end 80 and the inner opening 78 of pulley member 74. Of course, the use of a key type of locking mechanism is optional and is not essential to achieve the benefits of the bladeshaft assembly of the present invention.

An inner flange member 86 is disposed at the end of the shaft end 80 adjacent the outer edge of pulley member 74. Inner flange member 86 can also include an optional keyed slot area so as to be joined with the pulley member 74 and tapered shaft end 80. Inner flange member 86 can include a forward edge portion 88 that fits within a slot 90 formed in the outer edge of pulley member 74. By securing the inner flange member 86 to the tapered shaft end 80 along with the outer flange member 92, the press fit relationship between the pulley member 74 and end shaft 80 can be further supplemented. The securing device 94 is shown as a threaded bolt arrangement but could be any other fastening means as is known to those skilled in the art of fasteners.

A blade key 96 extends between the inner flange member 86 and the outer flange member 92 and is effective so that when a cutting blade (not shown) is mounted between the two flanges 86, 92, it is secured in place.

Returning now to the sealing arrangement between the flange end cover 68 and the shaft slinger 70, it can be seen that a labyrinth 98 is formed therebetween. The labyrinth 98 is effective so as to present as difficult of a path as possible for contaminants such as dust and slurry from reaching the sealed bearings 66. In order for any such contaminants to reach the bearings 66, it must turn several corners, fit through the slight gap between the shaft member 58 and the opening 72 in the flange end cover 68, as well as an optional O ring or other sealing member 102 disposed between the bearings 66 and the flange end cover 68. As a further precaution to preventing contaminants from reaching the bearings 66, a re-lubrication path 100 is formed in the flange end cover 68. The re-lubrication path allows for lubrication to be pushed through the labyrinth 98 in a way to push any contaminants in the labyrinth back out through the opening to the labyrinth 100 formed between the flange end cover 68 and the shaft slinger 70.

Figure 5:
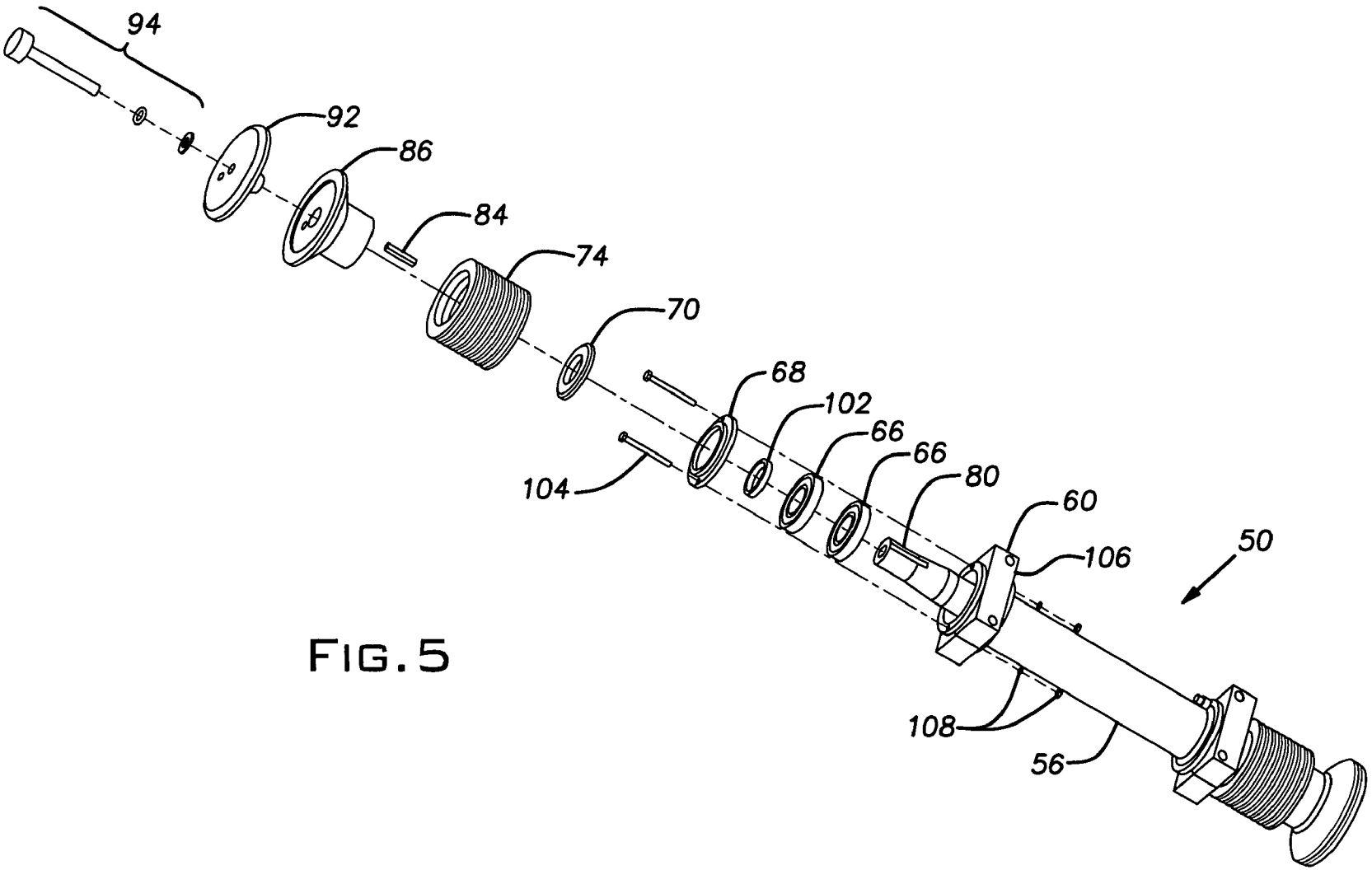
FIG. 5 is an exploded elevational view in component form of the bladeshaft assembly constructed in accordance with the present invention.

With reference now to FIG. 5, the bladeshaft assembly 50 is constructed in a way so as to dispose the bearings 66 into the raised ends 60 of the tubular member 56. It should be noted that by sizing the raised ends 60 larger than the diameter of the tubular member 56, the assembler of the bladeshaft assembly 50 can utilize the inner surface 106 of the raised end 60 as a leverage point for a tighter press fit of the pulley member 74 onto the shaft end 80.

As further seen in FIG. 5, the flange end cover 68 is mounted to the raised end 60 by means of through bolts 104 that extend through the raised ends 60 and are fastened by conventional nut/washer arrangements 108. In this manner, should there be a need to gain access to the sealed bearings 66, it is possible to remove the flange end cover 68 even under conditions where the concrete dust and slurry contamination have formed a hardened coat of contaminants around the opening to the bearings 66. In prior art examples of bladeshaft assemblies such as shown in FIG. 1, once the contaminants have hardened around this area, it is nearly impossible to gain access to the sealed bearings thus necessitating a complete replacement of the bladeshaft assembly.

Although the hereinabove described embodiment of the invention constitutes the preferred embodiment, it should be understood that modifications can be made thereto without departing from the scope of the invention as set forth in the appended claims.

What is claimed is:

1. A bladeshaft assembly for a cutting saw comprising:

a hollow tubular housing member;

a shaft member extending coaxially through said tubular housing member, said shaft member having at least one end extending outwardly of said tubular housing member;

at least one bearing member disposed in surrounding relation to a portion of said shaft member;

means for sealing around said at least one end of said shaft member as it extends outwardly of said tubular housing member;

a pulley member mounted on said at least one end of said shaft member extending outwardly of said tubular housing member;

a tapered fit formed cooperatively between said pulley member and said at least one end of said shaft member so as to enable a press fit relation between said pulley member and said at least one end of said shaft member; and, wherein first and second gauge points are formed respectively between said pulley member and said at least one end of said shaft member, said first and second gauge points engaging one another so as to establish a predetermined placement of said pulley member on said at least one end of said shaft member.

2. A bladeshaft assembly for a cutting saw comprising:

a hollow tubular housing member;

a shaft member extending coaxially through said tubular housing member, said shaft member having at least one end extending outwardly of said tubular housing member;

at least one bearing member disposed in surrounding relation to a portion of said shaft member;

a pulley member mounted on said at least one end of said shaft member extending outwardly of said tubular housing member;

a cover seal member disposed on at least one end of said tubular housing member in a sealed surrounding relation to said at least one end of said shaft member, said cover seal member being effective so as to seal a space within said tubular housing member wherein said at least one bearing member is disposed;

a shaft slinger member disposed in cooperative adjacent relation to said cover seal member, said shaft slinger member and said cover seal member having a labyrinth path formed therebetween; and, wherein a re-lubrication path is formed in one of said cover seal member and said shaft slinger member so as to allow the introduction of lubrication into said labyrinth and thereby expunge any contaminant material disposed therein.

* * * * *